US011536084B2

(12) United States Patent
Fischer

(10) Patent No.: US 11,536,084 B2
(45) Date of Patent: Dec. 27, 2022

(54) ROLLING DOOR

(71) Applicant: Seuster KG, Lüdenscheid (DE)

(72) Inventor: Jörg Fischer, Dortmund (DE)

(73) Assignee: Seuster KG, Lüdenscheid (DE)

( * ) Notice: Subject to any disclaimer, the term of this patent is extended or adjusted under 35 U.S.C. 154(b) by 155 days.

(21) Appl. No.: 16/606,980

(22) PCT Filed: Mar. 13, 2018

(86) PCT No.: PCT/EP2018/056217
§ 371 (c)(1),
(2) Date: Oct. 21, 2019

(87) PCT Pub. No.: WO2018/219512
PCT Pub. Date: Dec. 6, 2018

(65) Prior Publication Data

US 2020/0131845 A1 Apr. 30, 2020

(30) Foreign Application Priority Data

May 31, 2017 (DE) ..... 102017005190.9

(51) Int. Cl.
*E06B 9/13* (2006.01)
*E06B 9/17* (2006.01)
*E06B 9/62* (2006.01)

(52) U.S. Cl.
CPC ..... *E06B 9/13* (2013.01); *E06B 9/17076* (2013.01); *E06B 9/62* (2013.01); *E06B 2009/135* (2013.01)

(58) Field of Classification Search
CPC ..... E06B 9/08; E06B 9/13; E06B 2009/135; E06B 2009/1527; E06B 9/17076;
(Continued)

(56) References Cited

U.S. PATENT DOCUMENTS 1,587,940 A * 6/1926 Bretosy ..... E06B 9/13 160/271
5,332,021 A * 7/1994 Todd ..... A47K 3/38 160/133
(Continued)

FOREIGN PATENT DOCUMENTS

CA 3073123 A1 * 2/2019 ..... E06B 9/13
CA 3095958 A1 * 10/2019 ..... E05D 15/24
(Continued)

OTHER PUBLICATIONS

International Preliminary Report on Patentability dated Dec. 12, 2019 for International Application No. PCT/EP2018/056217, 12 pages.
(Continued)

*Primary Examiner* — Daniel P Cahn
*Assistant Examiner* — Matthew R. Shepherd
(74) *Attorney, Agent, or Firm* — Schwabe, Williamson & Wyatt, P.C.

(57) ABSTRACT

The invention relates to a rolling door comprising a door leaf which can be moved between an open position, in which it at least partially releases a wall opening and forms a multi-layer winding above the wall opening, and a closed position, in which it at least partially closes the wall opening, as well as comprising joint assemblies arranged in the region of the lateral edges of the door leaf, at least sections of which are running in the direction of gravity in the closed position, and secured to the door leaf, for guiding the door leaf movement, each of which includes a plurality of joint elements articulately connected relative to joining shafts running perpendicular to the lateral edges and approximately parallel to the door leaf plane, wherein at least sections of the door leaf are made of a bendable material, such as a plastic film, which is stabilised by two, three or more stabilising devices running perpendicular to the lateral edges and in the
(Continued)

door leaf plane, wherein the door leaf is only connected to the joint assemblies via the stabilising devices.

18 Claims, 14 Drawing Sheets

(58) Field of Classification Search
CPC ... E06B 9/17; E06B 9/581; E06B 9/58; E06B 2009/1577
See application file for complete search history.

(56) References Cited

U.S. PATENT DOCUMENTS

| | | | | | |
|---|---|---|---|---|---|
| 5,484,007 | A * | 1/1996 | Rejc | E06B 3/485 | 160/133 |
| 5,488,982 | A * | 2/1996 | Rejc | E06B 3/485 | 160/133 |
| 6,123,139 | A * | 9/2000 | Kalempa | E05D 15/165 | 160/133 |
| 2003/0188837 | A1* | 10/2003 | Varley | E06B 9/70 | 160/264 |
| 2007/0062650 | A1* | 3/2007 | Rejc | E06B 9/08 | 160/133 |
| 2008/0251220 | A1* | 10/2008 | Rejc | E06B 9/62 | 160/266 |
| 2008/0295411 | A1* | 12/2008 | Rejc | E06B 9/62 | 49/445 |
| 2015/0368965 | A1* | 12/2015 | Meyere | E06B 9/581 | 160/133 |
| 2017/0044820 | A1* | 2/2017 | Fischer | E06B 9/17076 | |
| 2017/0101818 | A1* | 4/2017 | Frede | E06B 9/171 | |
| 2018/0258686 | A1* | 9/2018 | Christenson | E06B 3/5009 | |

FOREIGN PATENT DOCUMENTS

| | | | | | |
|---|---|---|---|---|---|
| DE | 4015214 | A1 | | 11/1991 | |
| DE | 9416624 | U1 | | 12/1994 | |
| DE | 19915376 | A1 | | 10/2000 | |
| DE | 10236648 | A1 | * | 2/2004 | B60J 5/14 |
| DE | 10236648 | A1 | | 2/2004 | |
| DE | 20320336 | U1 | | 5/2004 | |
| DE | 102004015692 | A1 | | 10/2005 | |
| DE | 102009017767 | A1 | | 10/2010 | |
| DE | 102012111611 | A1 | | 6/2014 | |
| EP | 0922830 | A1 | | 6/1999 | |
| WO | WO-2021052637 | A1 | * | 3/2021 | E06B 9/11 |

OTHER PUBLICATIONS

International Search Report dated Dec. 6, 2018 for International Application No. PCT/EP2018/056217, 9 pages.

* cited by examiner 22
20
22
10
26
12
40
32
30
32
36

A
32
30
36

A
32

12
100
40
40
12
40

Fig. 3
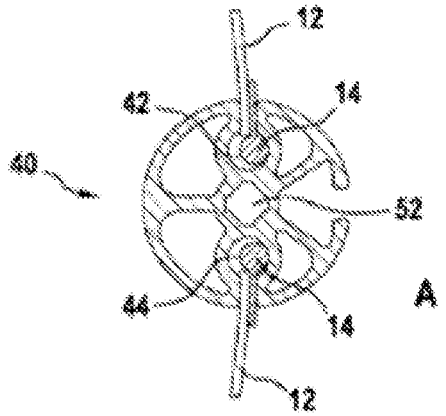
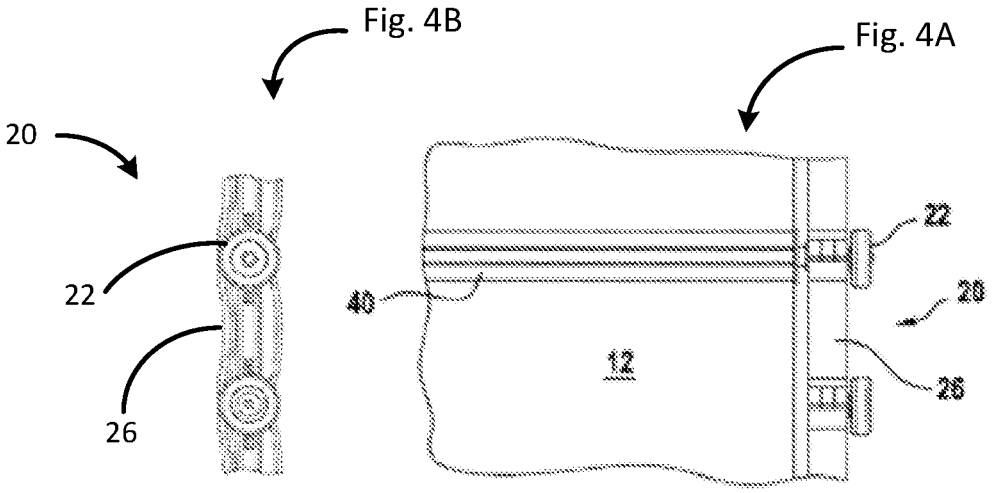

Fig. 7a
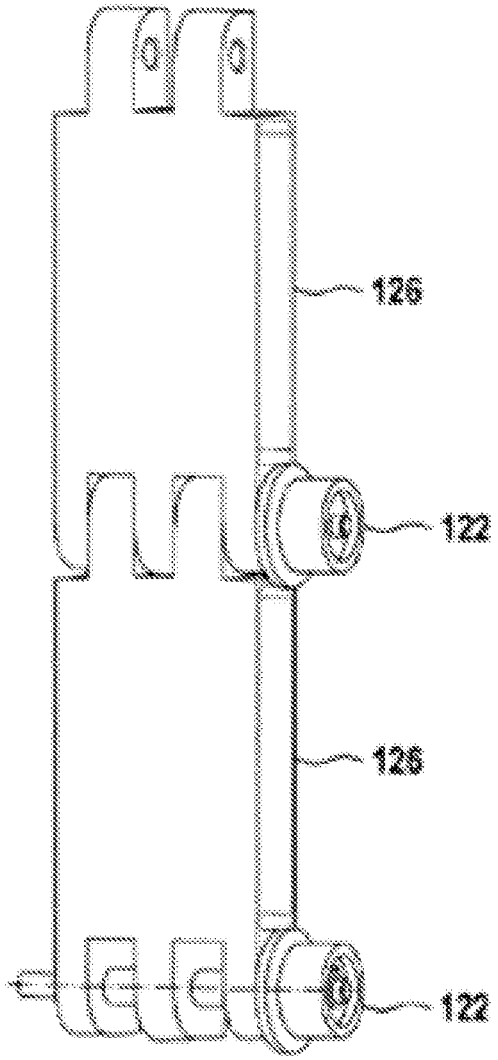
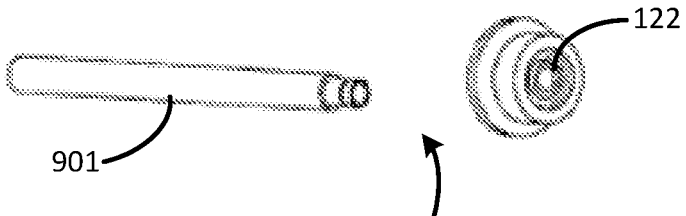
Fig. 7a1

360
360
370
380

370
380
380
370

ROLLING DOOR

CROSS REFERENCE TO RELATED APPLICATION

The present application is a 35 U.S.C. § 371 national phase entry application of, and claims priority to, International Patent Application No. PCT/EP2018/056217, filed Mar. 13, 2018, which claims priority to German Patent Application No. DE 102017005190.9, filed May 31, 2017, the disclosures of which are hereby incorporated by reference in their entirety for all purposes.

BACKGROUND

The invention relates to a rolling door comprising a door leaf which can be moved between an open position, in which it at least partially releases a wall opening and forms a multi-layer winding above the wall opening, and a closed position, in which it at least partially closes the wall opening, as well as comprising joint assemblies arranged in the region of the lateral edges of the door leaf, at least sections of which are running in the direction of gravity in the closed position, and secured to the door leaf, for guiding the door leaf movement, each of which includes a plurality of joint elements articulately connected relative to joint axes running perpendicular to the lateral edges and approximately parallel to the door leaf plane.

Such rolling doors are described, for example, in DE 10 2009 017 767 A1. They are employed as so-called high-speed doors for locking industrial facilities among other things. For this task, it is critical that the door leaf movement is safely guided. Furthermore, it should be noted that there often is very little space for accommodating the door leaf in the open position. Regarding these requirements, the aforementioned document already provides for a rolling door, in which at least one joint assembly has at least one joint plate mounted and secured to an end face approximately perpendicular to the joint axis of a rigid door leaf member embodied, for example, as sandwich elements. Thus, an increase in thickness of the overall structure due to the joint assembly may be avoided and the space needed for rolling doors in the open position may be reduced. However, it has been found that such doors still require a significant amount of space and that the travel speed of the door leaf is limited.

In light of these problems of the prior art, it is the objective of the invention to provide a rolling door that can be stowed in the open position with reduced space requirements and allows for high speeds during opening and closing, while ensuring reliable guidance for the door leaf movement.

According to the invention, this objective is achieved by a further development of the known doors generally characterized by forming at least sections of the door leaf from a bendable material windable relative to a winding axis perpendicular to the lateral edges of the door leaf and parallel to the door leaf plane, such as a plastic film or sheet, which is stabilised by two, three or more stabilising devices running perpendicular to the lateral edges and in the door leaf plane, wherein the door leaf is only connected to the joint assemblies via the stabilising devices.

Forming the door leaf at least partially from a bendable material allows for a reduced required space, since the material itself conforms to the winding to be formed in the open position and therefore allows for a low helix diameter in the open position. At the same time, a robust door leaf is achieved by the stabilising devices of the door leaf. The guiding of the door leaf is carried out by the joint elements of the joint assemblies, which are coupled to the stabilising devices, such that the pulling and pushing forces occurring during the door leaf movement may be transmitted via the joint assemblies. Accordingly, the door leaf can weigh very little. It just has to be ensured that the stabilising devices of the door leaf are securely coupled to the joint elements of the joint assemblies.

A commercially available, preferably transparent, PVC and/or polycarbonate can be used as a flexible material for manufacturing doors according to the invention. The thickness of the plastic sheet is selected based on the requirements. Using the bendable material in the form of a plastic film or sheet may ensure that the shape of the door leaf matches the helical shape in the open position, while maintaining a low winding radius.

Polycarbonate in particular has exhibited excellent properties for use in doors according to the invention. This material has a high resilience as well as sufficient bending stiffness for following the winding contour even at great widths. The material has further positive properties as well, such as a high impact resistance.

Thus, the inventive rolling doors combine the advantages of a rolling door structure with rigid blades and lateral joint assemblies with the advantages of film doors, in order to provide a high speed door that allows for high opening and closing speeds as a result of the bendable door leaf structure, while providing reliable guidance by the joint assemblies and reducing the stress on the door leaf by transmitting pushing and pulling forces via the joint assemblies. A particularly stable connection of the door leaf to the joint assemblies can be achieved by using the stabilizing devices already provided for avoiding bulges due to wind loads. The stabilizing devices in conjunction with the joint assemblies form a bending-resistant framework or skeleton for the bendable door leaf.

In one preferred embodiment of the invention the door leaf includes a segment (hereinafter also referred to as a "pane") made of a preferably transparent and bendable or resilient material with segment or pane edges approximately perpendicular to the lateral edges of the door leaf, the segment or pane edges being provided with a thickened area and at least one stabilising device having a stabilising profile including a receiving area for receiving the thickened portion on a segment or pane edge. The stabilising profile advantageously spans the entire width of the door leaf in a direction perpendicular to the lateral edges of the door leaf, the receiving area preferably extending along the entire width of the door leaf as well. Additionally or alternatively, at least one segment edge can be configured without the thickened portion and can be positively secured to the stabilising device, such as by a clamping strip.

In every embodiment of the invention the segment or pane may extend across two, three or more joint elements in the direction of the door leaf movement or a direction running parallel to the lateral edges of the door leaf. In this case, the joint elements arranged between the stabilising devices are connected to the door leaf indirectly through the joint elements that are directly connected to the stabilising devices.

The stabilising profile can be embodied as a plastic strand pressing profile, for example. However, in a particularly preferable embodiment of the invention the stabilising profile is an aluminium strand pressing profile. Such an aluminium strand pressing profile combines high strength with low weight.

The thickened portion on the segment or pane edges can be achieved by adhering or welding piping strips thereto, which are received positively into corresponding receiving areas on the stabilising profiles. However, other connection means are also contemplated, such as via a clamping strip that allows for easy exchanges of the bendable or resilient segments when installed.

In rolling doors according to the invention, the door leaf is only connected to the joint assembly, which can be configured as a hinge strap, for example, via the stabilising profiles that also serve as wind reinforcements. The lateral edges of each pane or door leaf segment may extend across two, three or more joint elements, wherein some joint elements are only connected to the door leaf segments or panes indirectly via the joint elements that are directly connected to the stabilising devices.

Within the context of the invention, attaching at least one segment edge to the stabilising device through a clamping element releasably fixable to the stabilising device and preferably received at least partially within the stabilising device and/or abutting the stabilising device has proven particularly useful. In this embodiment of the invention it is particularly easy to exchange each pane or door leaf segment by releasing the clamping element from the stabilising device and then removing the corresponding segment edge from the stabilising device. If both segment edges of a segment are attached to the stabilising device through respective clamping elements, the respective segment can be fully removed from the door leaf without affecting the framework or skeleton comprised of the joint assemblies and the stabilising devices.

In one particularly preferable embodiment of the invention the segment edge is disposed between the clamping element of a sealing strip releasably fixable to the stabilising device to provide a sealed transition between the stabilising device and the door leaf segment.

The intermediate hinge points of the joint assembly or hinge strap are not connected to the bendable material. The hinge strap or joint assembly absorbs the pushing or pulling forces during opening and closing movements. The attachment of the stabilising profiles or wind reinforcements to the hinge strap can be implemented in any manner within the hinge point pattern. Thus, different pane heights can be achieved. For narrow doors, the number of stabilising profiles or wind reinforcements selected can be low, i.e. the section height can be large, while wide doors can be equipped with several stabilising profiles or wind reinforcements having smaller section heights for stabilisation.

Regarding the structure, it has proven useful to provide the door leaf with at least two panes arranged in series in the direction of the door leaf movement and made of a bendable material, the panes sandwiching a stabilising profile with two receiving areas for receiving thickened portions provided on pane edges facing each other. Thus, the stabilising profile connects adjacent panes of bendable material.

As discussed above, it has proven useful for obtaining a stable door leaf structure to include at least one stabilising device extending across a width of the door leaf parallel to a joint axis. A smooth attachment of the stabilising device without interfering with the movement of the joint assembly can be achieved by connecting the stabilising device to at least one, preferably two joint assemblies provided on opposing lateral door leaf edges.

Specifically with particularly high or wide door leaves, it has proven advantageous for the desired stabilisation to provide at least one reinforcing strip extending approximately parallel to the lateral door leaf edge and fastened to the door leaf. Using such reinforcing strips, which can also be, for example, adhered and/or welded to the door leaf panes, sufficient overall stability can be reached even though the material of the pane itself does not provide sufficient bending stiffness.

Similar to the rolling doors described in DE 10 2009 017 767 A1 a rolling door according to the invention with a bendable door leaf may be associated with at least one helical guide track for guiding the door leaf movement and determining the open position of the door leaf, wherein at least one joint element may include a guide assembly on the side thereof facing away from the door leaf cooperating with the guide track in guiding the door leaf movement, advantageously including at least one guide roller, rotatably mounted relative to a roller axis running parallel to the joint axes, preferably received within a guide track at least in the open position of the door leaf.

During operation of the known rolling doors with a door leaf consisting at least partially of a bendable material, such as a plastic film, and an oval-helical guide track for guiding the door leaf movement it has become apparent that high door leaf speeds may lead to increased wear on the guide track and the door leaf. According to another aspect of the invention, which can be used advantageously in conjunction with the aspects of the invention explained above, this problem is solved by a door, specifically a rolling door, comprising a door leaf which can be moved between an open position, in which it at least partially releases a wall opening and forms a multi-layer winding above the wall opening, and a closed position, in which it at least partially closes the wall opening, and at least sections of which are formed from a bendable material, such as a plastic film, substantially characterized in that the leading edge of the door leaf during an opening movement is formed by a leading stabilising device connected to an edge of a segment made of a bendable material, which edge is uppermost in the closed position, in a non-rotary manner and connected to a guide arrangement in a non-rotary manner that cooperates with a guide track, which is preferably defined by guide rails and at least sections of which are curved.

This solution is based on the realization that, in the operation of conventional doors, the increased wear observed during high door speeds is caused by the upper edge of the door leaf of a bendable material is diverted while entering the helical guide track, such that the door leaf initially forms an inward bulge that later in the opening process suddenly transitions into an outward bulge which is maintained in the opening position. The sudden change of the inward bulge to the outward bulge during the opening movement leads both to increased stress on the door leaf itself as well as an increased radial load on the guide track. This results in the observed increase in wear.

The non-rotary attachment of the upper edge of a door leaf segment of a bendable material to the stabilising device that forms the leading edge of the door leaf during opening movements as well as the non-rotary attachment of the stabilising device to the guide arrangement cooperating with the guide track and following the course thereof leads to the upper edge of the door leaf segment of bendable material being forcibly diverted outward, as the guide arrangement enters the helical guide track, thereby forcing the door leaf segment into an outward bulge. This outward bulge of the upper segment is transmitted to the subsequent segments of the door leaf during the opening movement, if the subsequent stabilising devices between each door leaf segment are rotatably connected to the guide rollers to be guided through the guide track, wherein the roller axes can run parallel, specifically coaxially, to the joint axes of the articulately connected joint elements, as mentioned above. In this manner, a defined curvature of the door leaf during the opening movement can be ensured. Therefore, excessive loads on the door leaf and the guide track can be avoided and an increase in wear can be prevented.

The guide arrangement connected to the leading stabilising device in a non-rotary manner may include two, three or more guide pins or rollers arranged in series in the direction of the door leaf movement and attached to common carrier which is connected to the leading stabilising device in a non-rotary manner. By using two, three or more guide pins or rollers attached in series to a common carrier in the direction of the door leaf movement and cooperating with the guide rail enables the orientation of the guide arrangement to substantially follow the course of the guide track. Advantageously, the carrier is attached to a joint element leading during the opening movement which also allows for a non-rotary attachment of the carrier to the joint element. In case of a guide arrangement including two, three or more guide rollers arranged in series in the direction of the door leaf movement, each of them may be connected to the common carrier, which is connected to the leading stabilising device in a non-rotary manner, in a rotatable manner relative to a roller axis running parallel to the joint axes.

Instead of the conventional helical guide track, alternative guide tracks, such as an oval helix, a horizontal redirection or a vertical guide can be implemented depending on the required space of the structural body.

In every embodiment of the invention it has proven favourable to associate at least one joint element with a seal assembly that may abut a boundary surface of the door leaf in the closed position. In this context it has proven particularly advantageous for the individual seal assemblies associated with the joint elements to form a continuous sealing strip in the form of track seals in the closed position for engaging each segment or pane of the door leaf or even the entire lateral edges of the door leaf in the closed position.

In the context of the invention, embodiments in which the seal assembly abuts the outer boundary surface of the door leaf facing away from the space to be closed by the door leaf are also contemplated. However, it has been found that a particularly reliable seal can be achieved in cases, where the seal arrangement abuts the inner boundary surface of the door leaf facing away from the outer boundary surface and towards the space to be closed by the door leaf. This aspect of the invention is a result of a detailed kinematic analysis of the door leaf movement upon entering the helical guide track. During this phase of the movement the door leaf is pushed outwards and may thus impact a seal assembly outwardly adjacent thereto potentially leading to an increase in wear on the door leaf itself and on the seal assembly. However, if the seal assembly engages an inner boundary surface of the door leaf, this cause of wear is eliminated overall improving the seal.

As mentioned above, forming a continuous sealing strip in the form of track seals from the individual seal assemblies associated with the joint elements in the closed position has proven advantageous. In this context, embodiments are contemplated in which each seal assembly includes at least one sealing element extending across two, three or more joint elements, providing a gap-free seal across the corresponding number of joint elements. Said sealing elements may be attached to the joint elements by separate fasteners mounted to the joint elements. Alternatively or additionally, seal receivers may be integrated into each joint element. A composite of plastic and metal can be used for manufacturing the joint elements optionally including integrated sealing elements.

The door leaves of inventive doors may be moved into the open position at particularly high speeds. This requires some care, such that warpage of the door leaf in the region of the door leaf edge trailing during the opening movement may be avoided when reaching the open position and decelerating the door leaf as a result thereof. In this regard, providing the invention with a biasing device coupleable to an edge of the door leaf trailing behind during the opening movement throughout the opening movement, to decelerate the opening movement and provide a biasing force forcing the door leaf from the open position into the closed position has proven particularly useful. Coupling the biasing device to the trailing edge of the door leaf allows the lower region of the door leaf in the closed position including the edge trailing behind during the opening movement to be biased by the biasing device in the desired manner when reaching the open position. Thus, warpage of the door leaf in the region of the edge trailing behind during the opening movement may be avoided. In addition, the biasing device may provide a breakaway torque useful for initiating a closing movement due to the door leaf including the biasing device, optionally indirectly, coupled to the edge thereof trailing behind during the opening movement, being biased towards the closed position.

In the context of the invention it has proven particularly advantageous for the biasing device to include a tension spring extending approximately in the direction of gravity and embodied, for example, as an elastic cord, i.e. a cord at least partially made of an elastomeric material, the upper end of which is captured and entrained by a driver attached in the region of the trailing edge of the door leaf in opening movements during the opening movement. Additionally or alternatively, the use of tension springs is also contemplated.

In every embodiment of the invention kinematics suggest providing at least one joint element in a length more than 20 mm, preferably more than 30 mm and/or less than 400 mm in a direction running parallel to the lateral edges in the closed position.

BRIEF DESCRIPTION OF THE DRAWINGS

Hereinafter the invention will be explained with reference to the drawings which are explicitly referenced for all features essential to the invention and not set forth in detail in the description. In the drawings:

FIG. 1A shows a rear view of the door, FIG. 1B shows a side view of the door, and FIG. 1C shows a detailed view of the components circled and designated "A" in FIG. 1B;

FIG. 3 shows a detailed illustration of the door leaf of a rolling door according to the invention;

FIGS. 4A and 4B shows a detailed illustration of the rolling door according to FIGS. 1A and 1B, specifically FIG. 4A shows a front view of the rolling door, and FIG. 4B shows a side view of the rolling door;

FIGS. 7*a* and 7*b* show detailed illustrations of a joint element of a joint assembly of a door according to the invention, wherein FIGS. 7*a*1 and 7*b*1 show exploded views of the rollers 122 with a slide bearing;

FIG. 8A shows a perspective view of the seal assembly 370 with joint elements 360, FIG. 8B shows a cross-section view of the seal assembly 370, and FIG. 8C shows a different perspective view of the seal assembly 370;

DETAILED DESCRIPTION

Figures 1A, 1B, 1C:
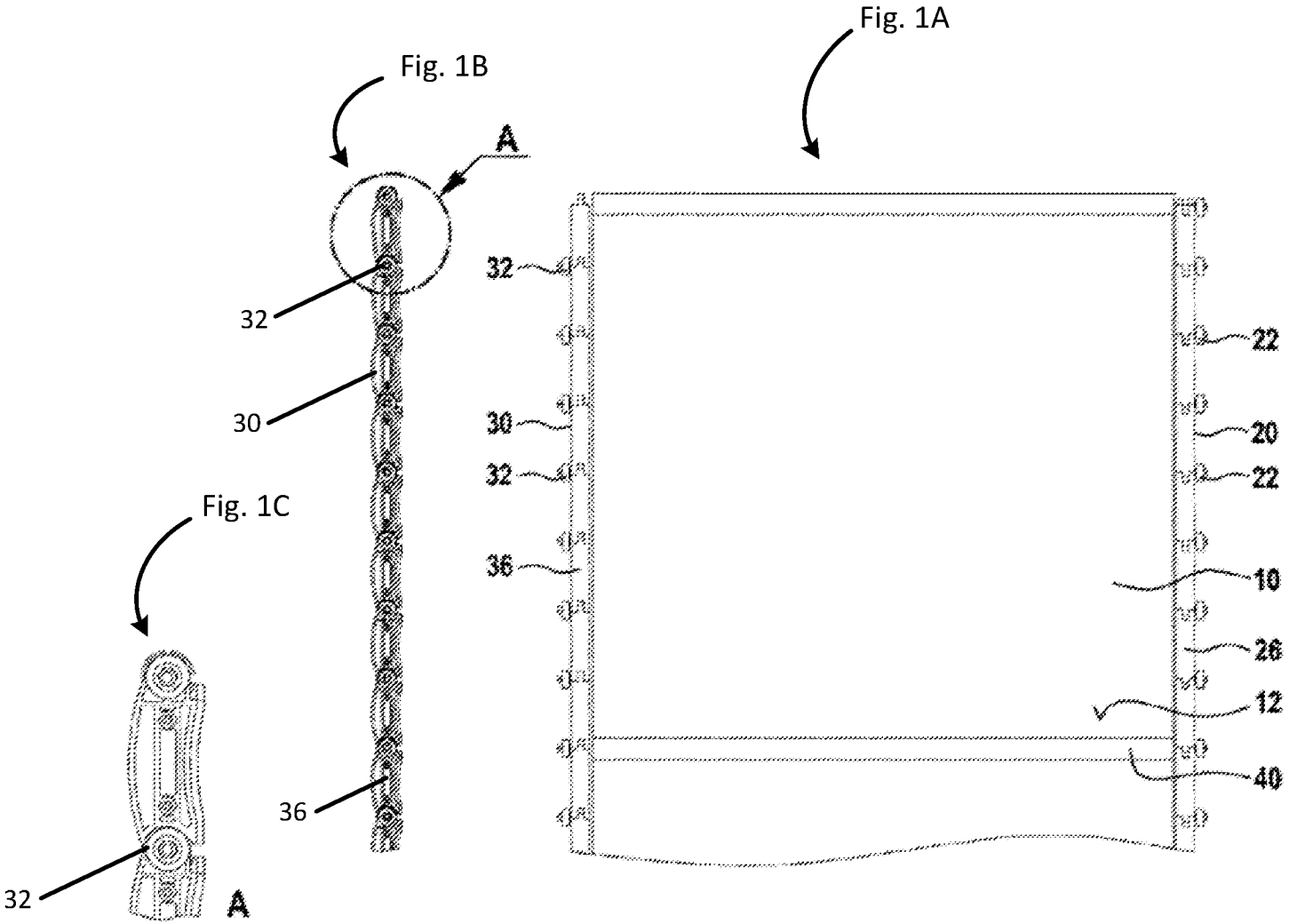
FIGS. 1A, 1B, and 1C shows a view of a rolling door, according to the invention, specifically

The rolling door shown in FIGS. 1A, 1B, and 1C, comprises a door leaf, generally indicated by 10, comprised of panes 12 of a bendable, transparent material connected to each other via stabilising profiles 40. Joint assemblies in the form of hinge straps 20 and 30, connected to the door leaf 10 via the stabilising profiles 40, are disposed on the lateral edges of the door leaf 10. The hinge straps include guide rollers 22 and 32, respectively, on the joints between each hinge element on the side thereof facing away from the door leaf 10, which may guide the door leaf movement using suitable guide rails.

According to FIGS. 1A, 1B, and 1C, each of the hinge straps 20 and 30 forming a push-pull assembly consists of hinge elements 26 and 36, respectively, having a fork-shaped receiver or the like engaging a stud of an adjacent hinge element. Both fork and stud are penetrated by a common hinge pin, causing an articulate connection between subsequent hinge elements. The roller axes of the guide rollers 22 and 32 run parallel to the joint axes, preferably colinearly thereto. Furthermore, the stabilising profiles 40 embodied as aluminium strand pressing profiles run parallel to the joint axes and roller axis. The stabilising profiles 40 may be attached to the joint assemblies 20 and 30 at the pivot points of the hinge straps.

Figure 2B:
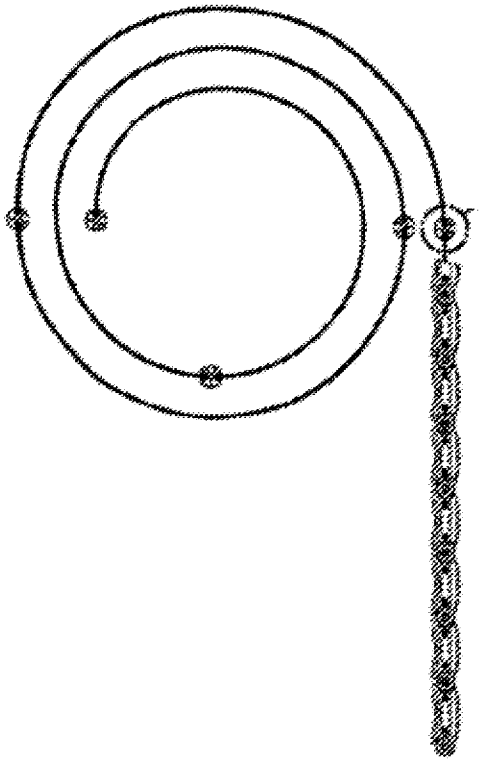
FIG. 2B shows a sectional side view 5 showing the sectional side view of the door without the helical guide track 100.
Figure 2A:
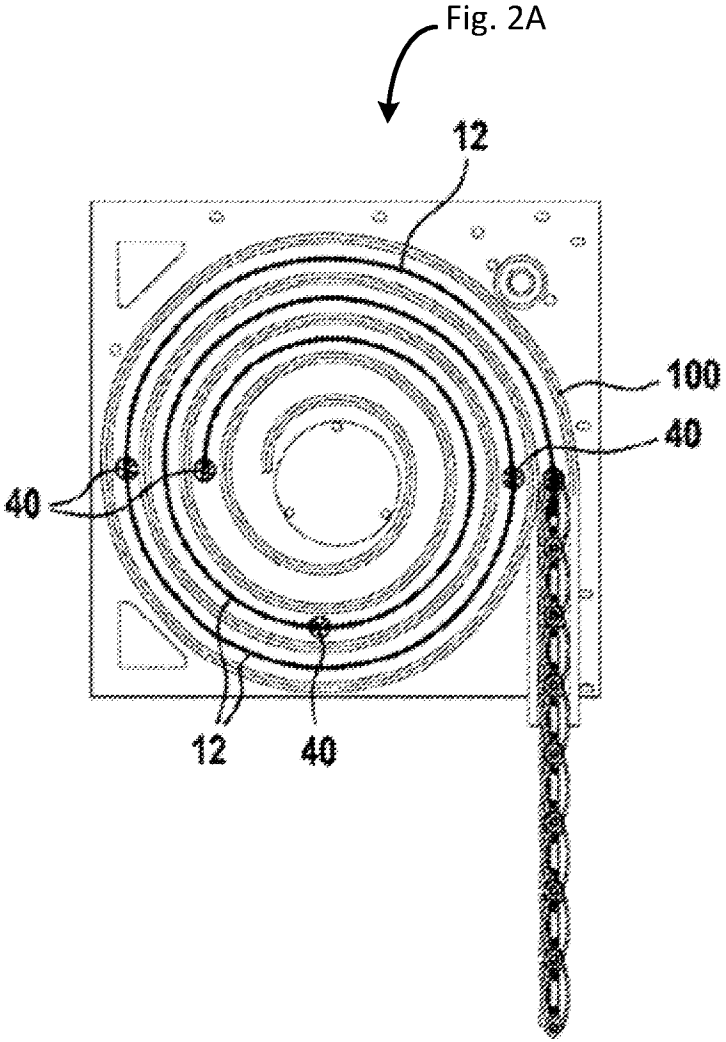
FIG. 2A shows a partially cut away side view 4 of a rolling door transitioning from the closed position into the open position, according to the invention.

According to FIGS. 2A and 2B, a rolling door according to the invention includes a helical guide track 100 entered by the guide rollers 22 and 32 attached to the hinge straps 20 and 30 upon reaching the open position. In FIGS. 2A and 2B, the joint elements 26, 36 in the region of the helical guide track are hidden, to better illustrate the door leaf itself. As can be seen, panes 12 of a bendable material are able to easily conform to the desired helical shape. For this purpose, no connection of the panes 12 themselves to the hinge straps is required. Rather, it is sufficient to secure just the stabilising profiles 40 between each pane in the joint assembly in the form of the hinge straps 20, 30. It is further shown, that each pane of bendable material may extend across a substantial height of the door leaf. This constitutes an advantage compared to conventional sectional doors by allowing for minimization of the helical diameter.

According to the FIG. 3, the panes 12 include thickened portions formed on the pane edges running perpendicular to the lateral edges by welding piping 14 thereto, the thickened portion being received within the receiving areas 42, 44 of the stabilising profiles. The width of the receiving areas 42 and 44 tapers from the receiving areas 42 and 44 in a radial direction, such that the receiving areas only permit passing of the panes 12 with piping strips adhered thereto, but not passing of the thickened portion or piping 14. The result is a secure connection of individual panes via the stabilising profiles 40. However, no transmission of pulling or pushing forces by said connections is necessary. The forces are transmitted by the hinge straps 20, 30 instead.

According to FIGS. 4A and 4B, the attachment of the hinge straps 20, 30 via the stabilising elements 40 is achieved using a screw running colinearly to the roller axes of the guide rollers 22, 32 and secured by a lock nut 50. The screw engages a corresponding recess 52 (see FIG. 3) within the stabilising profiles 40. FIGS. 4A and 4B shows that the joint axis of the articulate connection between adjacent hinge elements 26, the roller axis, the screw axis and the axis of the stabilising profile 40 are all approximately colinear.

Figure 5A:
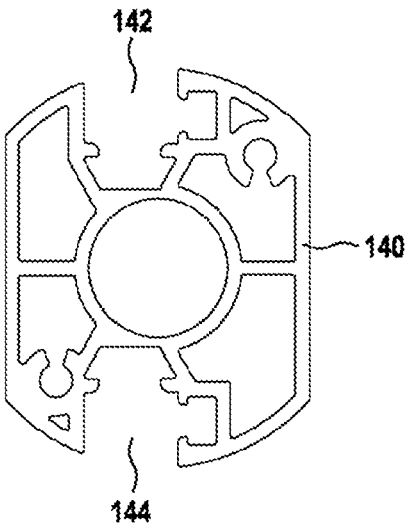
FIG. 5 shows an embodiment of a stabilising device of a door according to the invention.
Figure 5B:
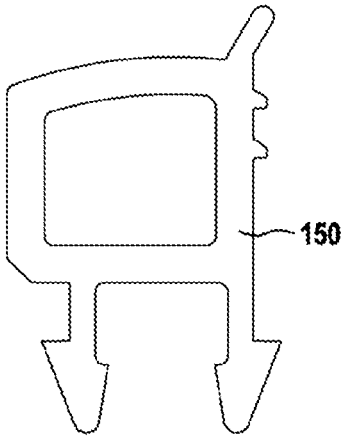
Figure 5C:
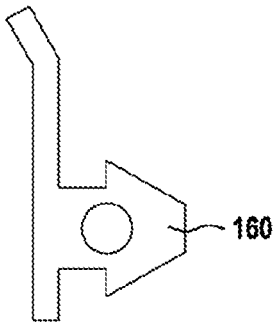
Figure 5D:
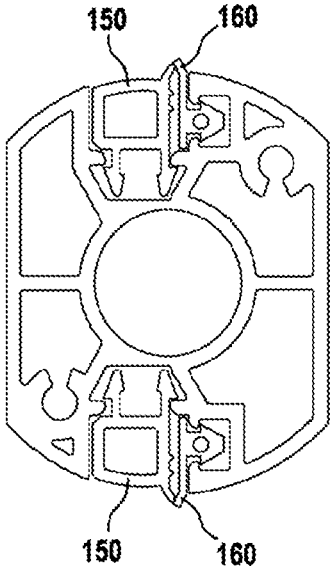

The embodiment according to the invention shown in FIG. 5 essentially differs from the embodiment discussed with reference to the FIG. 3 in that the stabilising profile 140 includes two receiving areas 142 and 144 configured to receive a clamping element 150 (see FIG. 5*b*) and a sealing strip 160 (see FIG. 5*c*). When assembled, the clamping element and the sealing strip are received within the receiving areas 142 and 144 with a segment or pane edge sandwiched between the clamping element 150 and the sealing strip 160 (see FIG. 5*d*).

Figure 6:
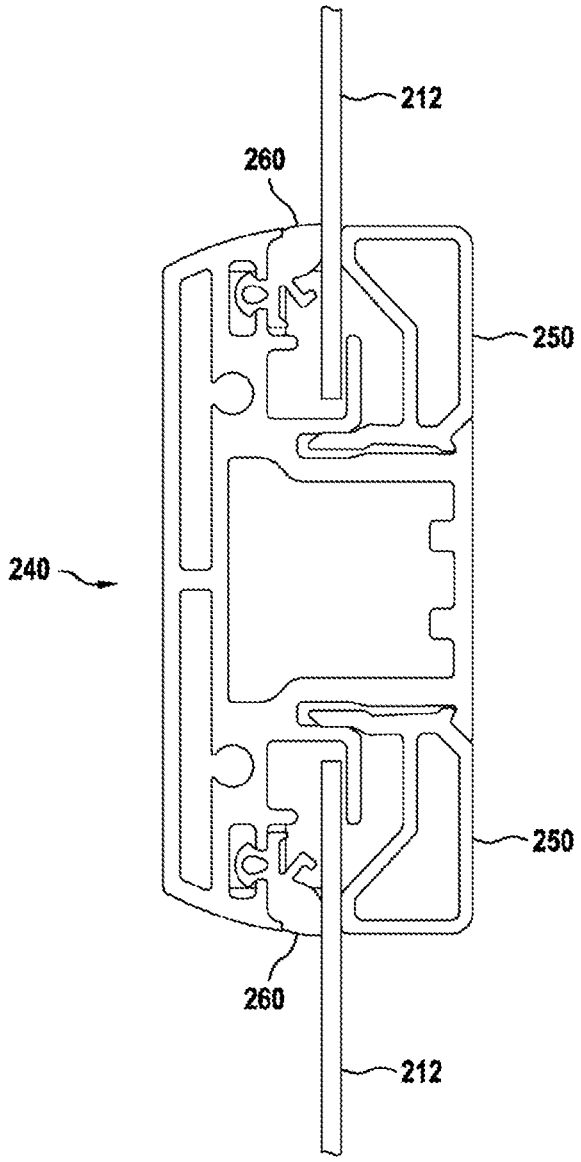
FIG. 6 shows another embodiment of a stabilising device of a door according to the invention.

The embodiment according to the invention shown in FIG. 6 essentially differs from the embodiment discussed with reference to FIG. 5 in that the clamping element 250 confines the stabilising device 240. This is done by clipping the clamping element 250 into the stabilising profile 240, as shown in FIG. 6. In this embodiment of the invention the edge of the pane 212 is again sandwiched between the clamping element 250 and the sealing strip 260, when assembled, wherein the sealing strip 260 is received within a corresponding receiver of the stabilising profile through a fastening bead.

FIG. 7*a* shows joint elements 126 embodied as aluminium strand pressing elements, illustrating the attachment of the rollers 122 to the joint assembly via slide bearings.

Figure 7B:
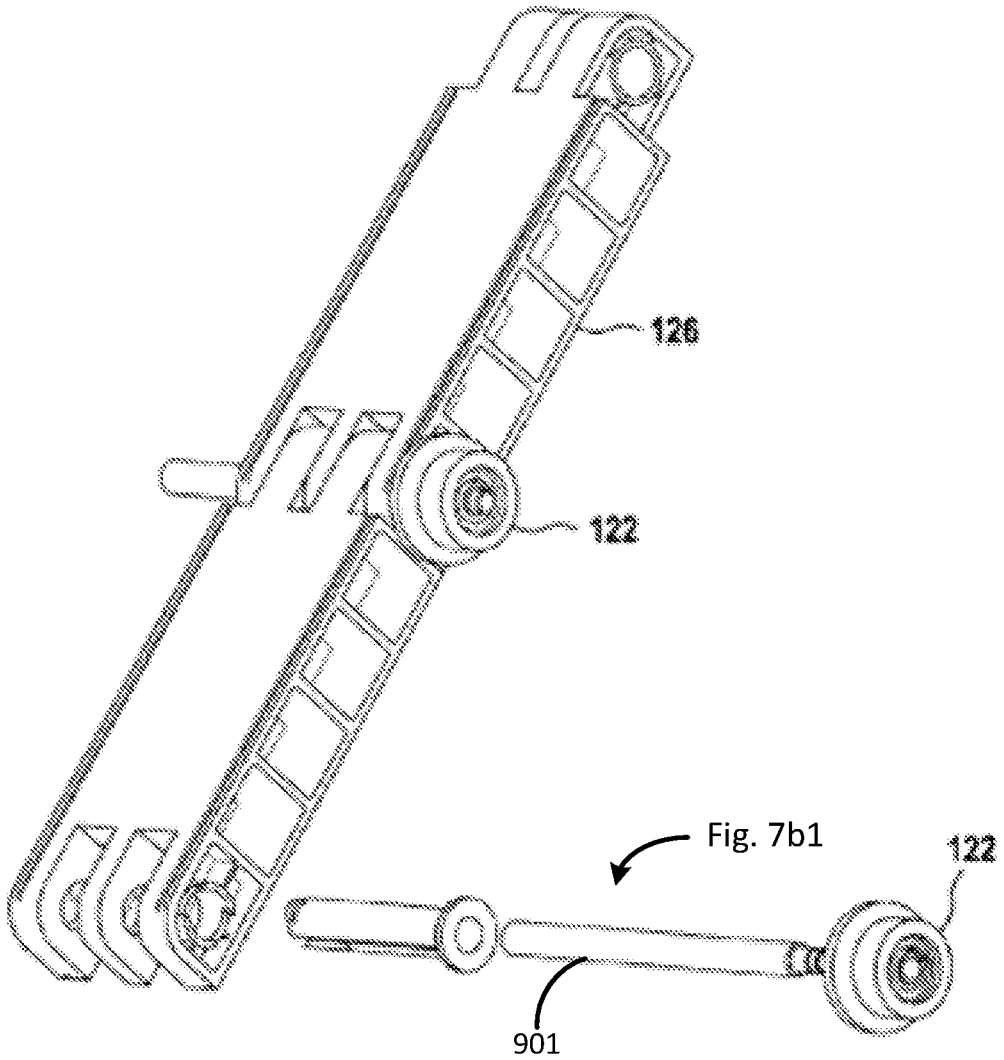

FIG. 7*b* shows joint elements embodied as a plastic injection moulded hybrid having a plastic injection moulded shell and a sheet steel core.

Figures 8A, 8B, 8C:
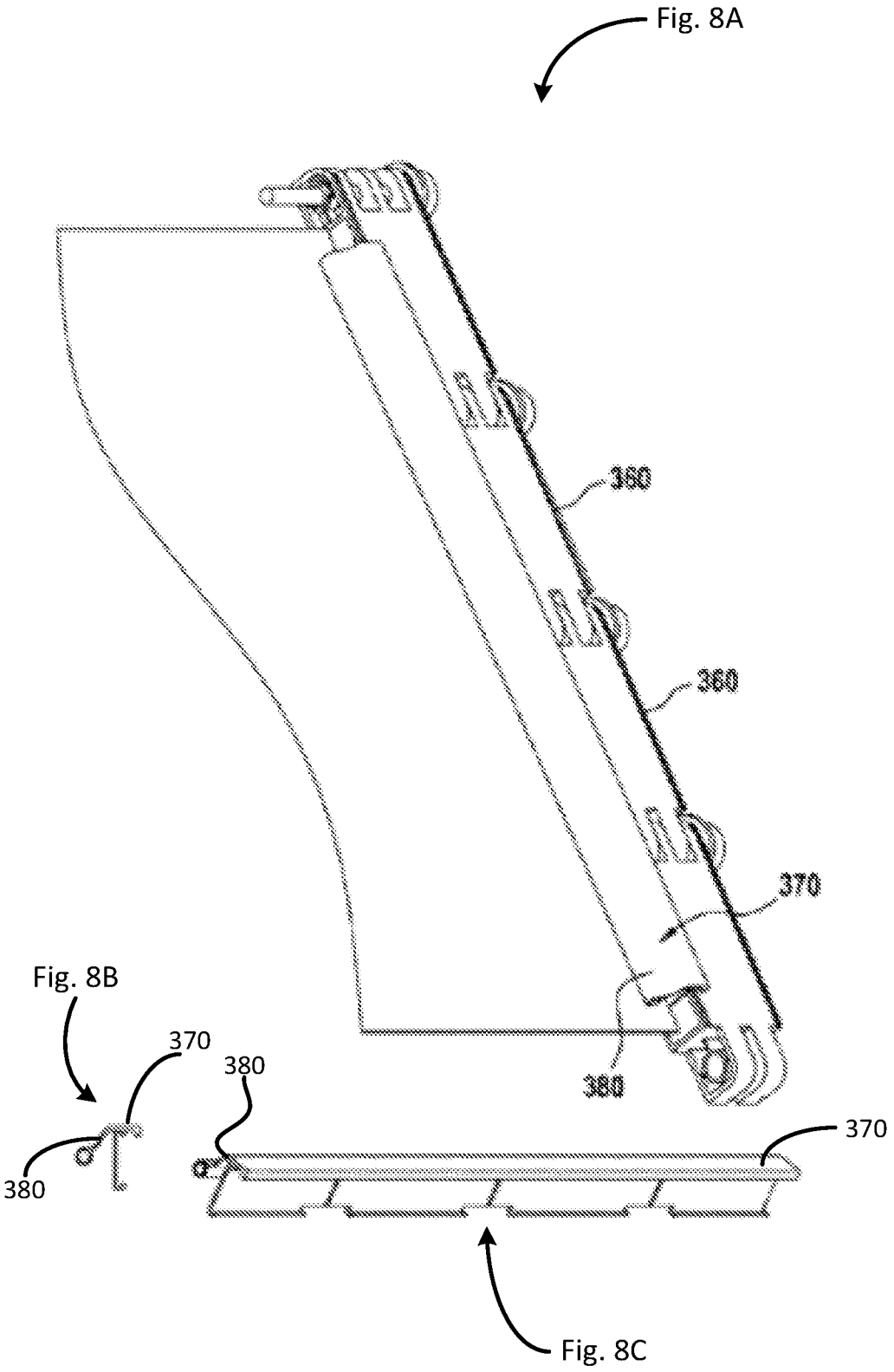
FIGS. 8A, 8B, and 8C shows illustrations of joint elements associated with seal assemblies of a door according to the invention, specifically

In the embodiment of the invention shown in FIGS. 8A, 8B, and 8C, a seal assembly 370 is placed onto joint elements 360. The seal assembly 370 includes a sealing strip 380 which forms a continuous seal when closed due to the sealing strip 380 extending across a plurality of joint elements 360. The sealing strip may engage an outer boundary surface of each segment or pane of the door leaf when closed.

Figure 9:
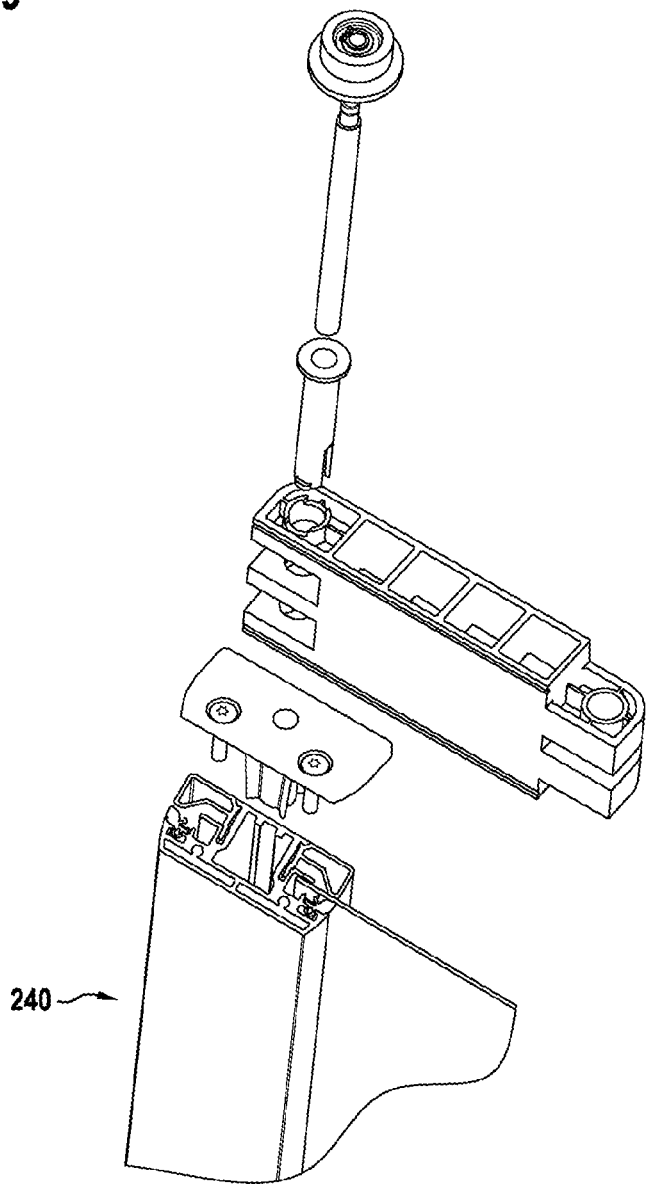
FIG. 9 shows the attachment of a stabilising device of a door according to the invention to a joint assembly of a door according to the invention.

FIG. 9 illustrates the attachment of the stabilising profiles 240 to the joint assembly via screw bolts running colinearly to the joint axes, wherein the stabilising profile is mounted to the joint assembly and the guide rollers are mounted to the joint assembly.

Figure 10A:
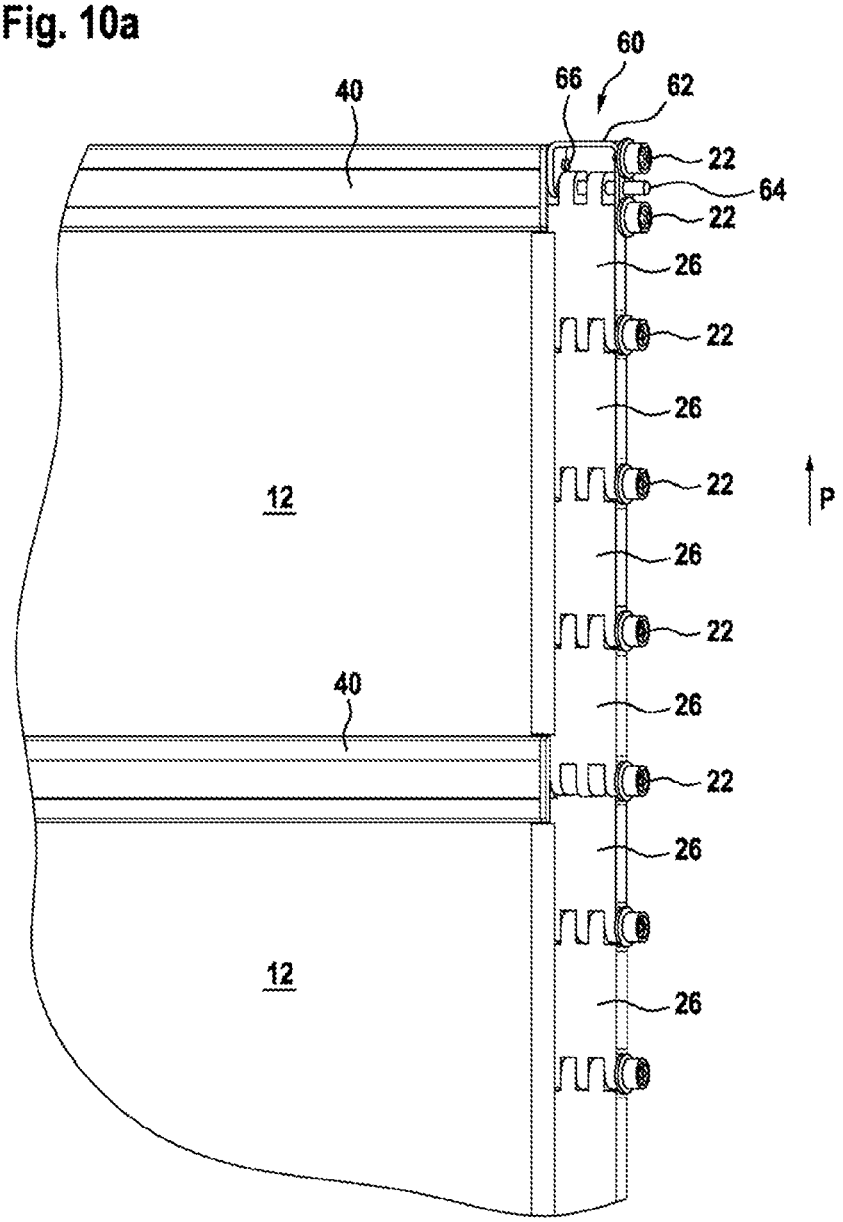
FIG. 10 shows detailed illustrations of a guide assembly of a door according to the invention.

In the embodiment of the invention shown in FIG. 10, the leading edge of the door leaf during opening movements is formed by a stabilising device 40 connected to a guide assembly generally indicated by 60 in a non-rotary manner. The guide assembly comprises a roughly U-shaped bracket 62. An outer leg of the U-shaped bracket 62 is fastened to the stabilising device 40 via a pin 64 and a locking screw 66.

The pin 64 and the screw 66 are spaced apart in the direction of the door leaf movement indicated by arrow P. Thus, a non-rotary attachment of the bracket 62 to the stabilising device 40 is achieved. Two guide rollers 22 arranged in series in the door leaf movement direction P are secured to the bracket 62, each fastened to the bracket 62 in a rotatable manner relative to roller axes running parallel to the joint axes of the joint or hinge elements 26. The bracket 62 is further connected to the hinge or joint element 26 leading during opening movements in a non-rotary manner.

Figure 10B:
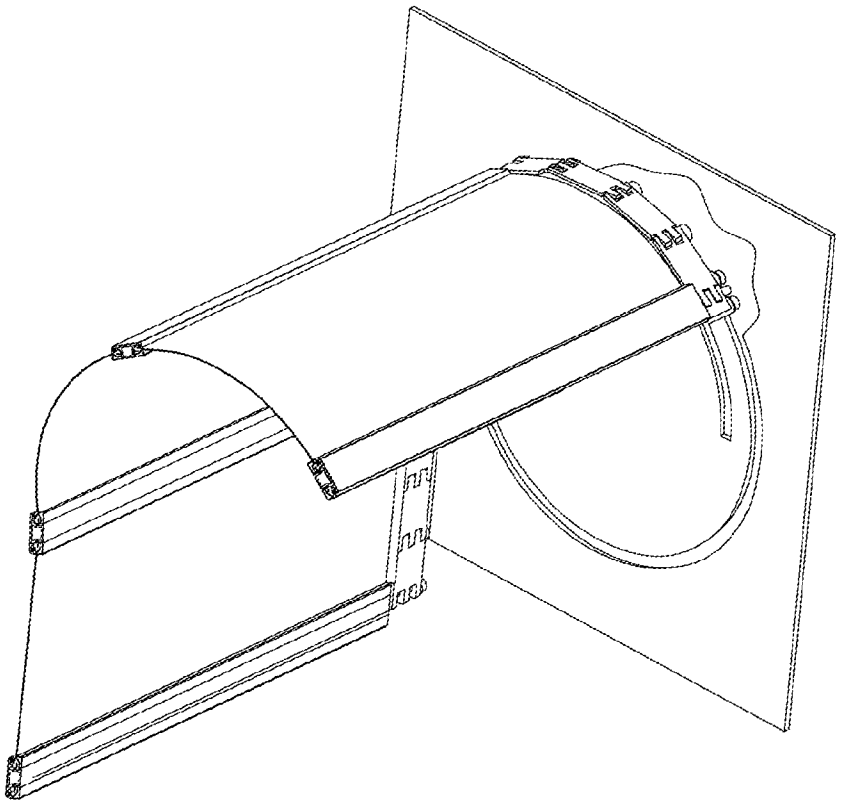

In FIG. 10*b* the door leaf equipped with the guide assembly 60 is shown entering the helical guide track. By forcibly guiding the guide rollers 22 mounted to the bracket 62 the stabilising device 40 connected to the guide assembly 60 in a non-rotary manner and the edge of the disc 12 leading during opening movements and connected thereto in a non-rotary manner are entrained and/or oriented along the guide track, forcibly bulging the disc 12 in an outward direction. This bulge is transmitted to the subsequent discs of the door leaf due to the connection of the stabilising devices 40 provided between each pane 12 to the guide rollers 22 rotatable relative to a roller axis running colinearly to the joint axes of the joint elements. By forcibly guiding the guide assembly 60, the guide rollers 22 mounted thereto, the stabilising device 40 connected thereto and the upper edge of the leading segment during opening movements or the leading pane 12 during opening movements connected to the stabilising device 40 an uncontrolled transition of the disc 12 and the subsequent discs 12 from an inner bulge to an outer bulge may be avoided, thereby increasing the resistance to the wear of the inventive door.

Further, the embodiment of the invention shown in FIG. 10 differs from the embodiments of the invention shown with reference to FIGS. 1 to 4 in that each joint element includes two fork-shaped receivers on one side thereof and studs engaging with the fork-shaped receivers of an adjacent joint element on the other side thereof. This results in an improved winding stiffness of the joint assembly.

Figure 11:
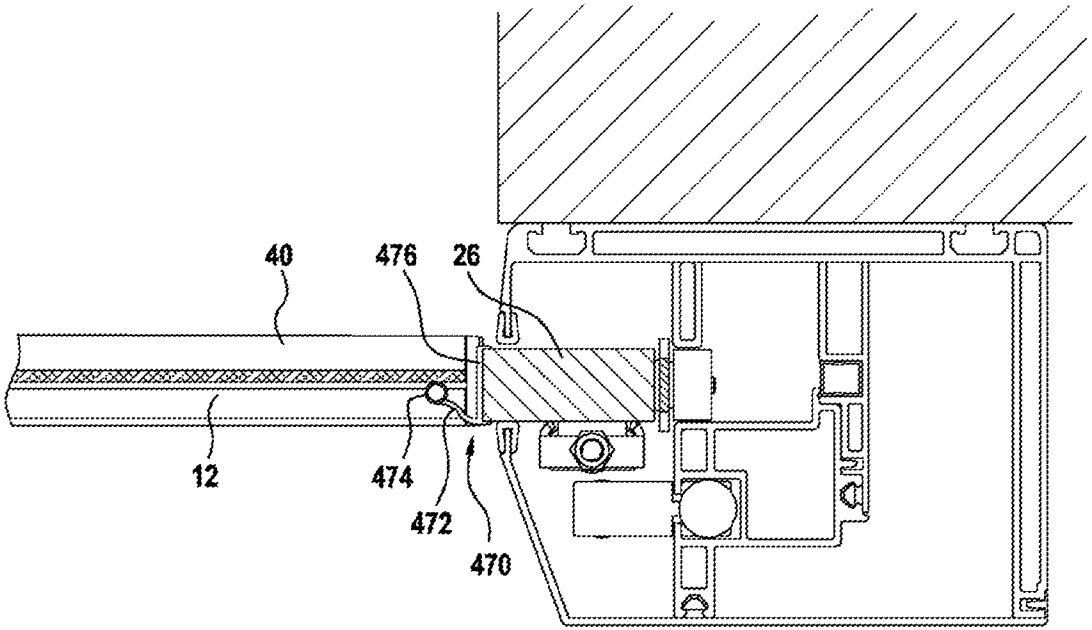
FIG. 11 shows a detailed illustration of the seal assembly of a door according to the invention.

The embodiment of the invention shown in FIG. 11 illustrates a seal assembly 470 abutting an inner surface of the panes 12 facing toward the space to be closed by the door leaf. The seal assembly 470 comprises a U-shaped sealing profile extending across one, two, three or more joint elements 26, from which a sealing lip 472 extends towards an inner boundary surface of the disc 12.

The sealing lip 472 is equipped with a cavity seal 474 on an edge thereof facing the inner boundary surface of the pane 12, the cavity seal achieving a particularly reliable sealing effect. The sealing profile 476 of the seal assembly shown in FIG. 11 may extend across two, three or more joint elements extending between adjacent stabilising devices 240. In general, the seal assembly 470 extends approximately in the direction of gravity in the closed position of the door leaf.

Figure 12:
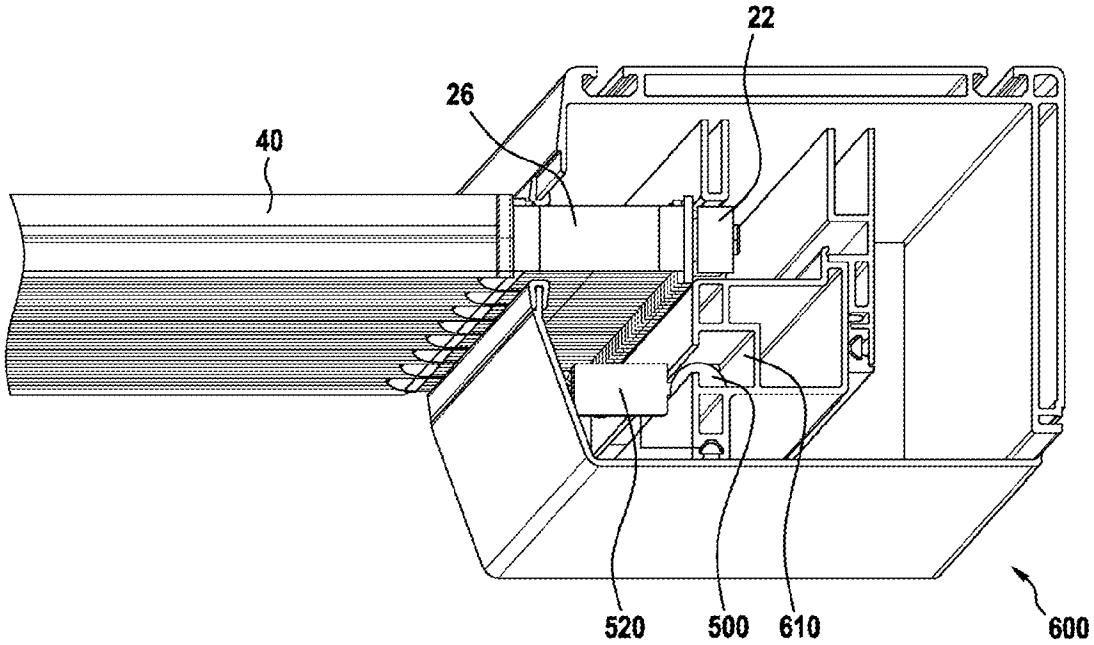
FIG. 12 shows a detailed illustration of a biasing device of a door according to the invention.

FIG. 12 shows a top perspective view of one of two lateral edge profiles 600 of a door according to the invention. The lateral edge profile 600 includes a channel 610 running in the direction of gravity, receiving a tension spring 500, the upper end of which can be seen in FIG. 12. A cantilever arm 520 is mounted to the upper end of the tension spring 500, wherein a driver (not shown) mounted to the lower joint element 26 trailing during opening movements comes to rest on the arm during the opening movement. The driver may entrain the arm 520 and thus the upper end of the tension spring 500 in an upward direction during the opening movement, thereby tensioning the tension spring 500. Consequently, the opening movement of the door leaf is decelerated and a breakaway torque promoting initiation of a closing movement is provided in an open position.

The invention is not limited to the embodiment discussed with reference to the drawing. Rather, adding additional stabilising strips parallel to the lateral edges of the door leaf providing additional stabilisation with respect to wind loads is also contemplated. Furthermore, the push-pull assemblies implemented in the form of hinge straps in the embodiment described may be implemented in a different manner. The connection of the stabilising elements to the push-pull assembly may also be configured articulately without a rigid connection. Thus, a floating bearing is created that helps avoid transmission of torsional forces from the winded segments to the push-pull assembly.

LIST OF REFERENCE NUMERALS

P direction of door leaf movement
20/30 hinge straps
22/32 guide rollers
26/36 hinge elements
42/44 receiving areas
10 door leaf
12 panes
14 piping
40 stabilising profile
50 locking nut
52 recess
60 guide assembly
62 bracket
64 pin
66 locking screw
100 guide track
122 rollers
126 joint elements
140 stabilising profile
142 receiving area
144 receiving area
150 clamping element
160 sealing strip
212 pane
240 stabilising device
250 clamping element
260 sealing strip
360 joint elements
370 seal assembly
380 sealing strip
470 seal assembly
472 sealing lip
474 cavity seal
476 sealing profile
500 tension spring
520 arm
600 lateral edge profile
610 channel

The invention claimed is:

1. A door, comprising a door leaf which is movable between an open position, in which it at least partially releases a wall opening and forms a multi-layer winding above the wall opening, wherein the door leaf includes lateral edges and defines a door leaf plane, and a closed position, in which it at least partially closes the wall opening, and comprises joint assemblies arranged in a region of the lateral edges of the door leaf, at least sectionally running in a direction of gravity in the closed position, and secured to the door leaf, for guiding a movement of the door leaf, wherein each of the joint assemblies includes a plurality of joint elements articulately connected to each other relative to joint axes running perpendicular to the lateral edges and approximately parallel to the door leaf plane, wherein the door leaf includes at least one segment made of a bendable material, which is stabilised by a plurality of stabilising devices, wherein the joint elements include: first joint elements that are directly connected to one of the plurality of stabilising devices, and second joint elements that are not directly connected to any of the plurality of stabilising devices, and wherein the at least one segment is arranged between two adjacent stabilising devices of the plurality of stabilising devices, wherein one of the lateral edges of the at least one segment runs approximately perpendicular to the plurality of stabilising devices and approximately parallel to the first and second joint assemblies while in the closed position, and extends across the second joint elements, wherein the second joint elements are arranged between at least two of the plurality of stabilising devices.

2. The door according to claim 1, wherein the at least one segment includes pane edges running approximately perpendicular to the lateral edges of the door leaf and provided with a thickened portion, wherein at least one of the plurality of stabilising devices includes a stabilising profile having at least one receiving region for receiving the thickened portion of the corresponding pane edge.

3. The rolling door according to claim 1, wherein at least one segment edge is bonded and/or positively attached to one of the plurality of stabilizing devices.

4. The door according to claim 1, wherein at least one of the plurality of stabilising devices extends parallel to a joint axis and is connected to at least one of the joint assemblies, provided on the opposing lateral door leaf edges, along the joint axis.

5. The door according to claim 1, characterized by at least one helical guide track for guiding the door leaf movement and for determining the open position of the door leaf.

6. The door according to claim 1, wherein the door leaf, in the open position at least partially releases the wall opening and forms the multi-layer winding above the wall opening, and wherein the door leaf, in the closed position, at least partially closes the wall opening, at least sections of which are formed from the bendable material, wherein a leading edge of the door leaf in an opening movement is formed by a leading stabilising device connected to the lateral edge of the at least one segment and is made of the bendable material, wherein the lateral edge of the at least one segment is an upper edge of the segment in the closed position, and is connected to a guide arrangement in a non-rotary manner.

7. The door according to claim 1, wherein a joint assembly of the joint assemblies is configured as a hinge strap.

8. The door according to claim 1, wherein the door comprises a roll-up door.

9. The door according to claim 1, wherein the bendable material is a plastic film.

10. The door according to claim 2, wherein the at least one segment includes at least two segments of bendable material successively arranged in a direction of the door leaf movement sandwiching the stabilising profile having two receiving regions for receiving the thickened portions provided on the pane edges facing each other.

11. The door according to claim 5, wherein at least one joint element of the plurality of joint elements includes a guide arrangement cooperating with the guide track in guiding the door leaf movement on a side thereof facing away from the door leaf, preferably comprising at least one guide roller rotatably mounted relative to a roller axis running parallel to the joint axes and preferably received within the guide track at least in the open position of the door leaf.

12. The door according to claim 6, wherein the guide arrangement connected to the leading stabilising device in a non-rotary manner includes two guide rollers successively arranged in the direction of the door leaf movement, each of which is connected to a common carrier, which is connected to the leading stabilising device in a non-rotary manner, in a rotatable manner relative to a roller axis running parallel to the joint axes.

13. The door according to claim 6, wherein at least one joint element of the plurality of joint elements is associated with a sealing arrangement which abuts a boundary surface of the door leaf in the closed position.

14. The door according to claim 6, further comprising a biasing device that is to be coupled to a trailing edge of the door leaf during the opening movement and is to be biased during the opening movement for decelerating the opening movement and for providing a biasing force forcing the door leaf from the open position into the closed position.

15. The door according to claim 6, wherein a length of at least one joint element of the plurality of joint elements is more than 20 mm, and/or less than 400 mm in a direction running parallel to the lateral edges of the door leaf in the closed position.

16. The door according to claim 12, wherein the carrier is attached to one of the first joint elements that leads in the opening movement of the door leaf.

17. The door according to claim 13, wherein the sealing arrangement includes at least one sealing member extending across two, three or more joint elements of the plurality of joint elements.

18. The door according to claim 14, wherein the biasing device includes a tension spring extending approximately in the direction of gravity, wherein an upper end of the tension spring is captured and entrained by a driver attached in a region of the trailing edge of the door leaf during the opening movement.

* * * * *